US006194332B1

(12) United States Patent
Rock et al.

(10) Patent No.: US 6,194,332 B1
(45) Date of Patent: Feb. 27, 2001

(54) ANTI-MICROBIAL ENHANCED KNIT FABRIC

(75) Inventors: Moshe Rock, Andover; Douglas Lumb; William K. Lie, both of Methuen, all of MA (US)

(73) Assignee: Malden Mills Industries, Inc., Lawrence, MA (US)

( * ) Notice: Subject to any disclaimer, the term of this patent is extended or adjusted under 35 U.S.C. 154(b) by 0 days.

(21) Appl. No.: 09/219,920

(22) Filed: Dec. 23, 1998

(51) Int. Cl.[7] ..... B32B 15/00; D04B 1/16

(52) U.S. Cl. ..... 442/312; 442/316; 442/317; 442/123

(58) Field of Search ..... 442/316, 312, 442/317, 123

(56) References Cited

U.S. PATENT DOCUMENTS

| | | |
|---|---|---|
| 5,047,448 | 9/1991 | Tanaka et al. . |
| 5,144,913 | 9/1992 | Yasui et al. . |
| 5,312,667 | 5/1994 | Lumb et al. . |
| 5,344,698 | 9/1994 | Rock et al. . |
| 5,405,644 | 4/1995 | Ohsumi et al. . |
| 5,547,733 | 8/1996 | Rock et al. . |

FOREIGN PATENT DOCUMENTS

| | | |
|---|---|---|
| 61-3741 | 9/1986 | (JP) . |
| 2307901 | 12/1990 | (JP) . |

*Primary Examiner*—Elizabeth M. Cole
(74) *Attorney, Agent, or Firm*—Gottlieb Rackman & Reisman

(57) ABSTRACT

A composite textile fabric for removing moisture away from the skin is provided. The composite fabric includes a first fabric layer comprising either a polyester, acrylic or nylon material which is naturally, or has been rendered, hydrophilic and a second fabric layer incorporating either a moisture-absorbent material such as cotton, or a synthetic yarn which has been rendered hydrophilic, or a combination thereof. The first and second fabric layers are formed concurrently by knitting a plaited construction. The second fabric layer is exclusively blended with treated synthetic fibers having anti-microbial properties. An elastomeric yarn material may be added to both layers so that the composite fabric is stretchable.

17 Claims, No Drawings

ANTI-MICROBIAL ENHANCED KNIT FABRIC

BACKGROUND OF THE INVENTION

This invention relates to a composite textile fabric, and more particularly, to a composite fabric comprising first and second fabric layers, in which the first fabric layer is made from a synthetic yarn, and the second fabric layer is blended with treated fibers having anti-microbial properties.

Most textile fabrics are likely to result in the substantial enclosure of moisture between the wearer's skin and undergarments or between the undergarments of the wearer and the outerwear. When moisture saturation takes place, excess moisture condenses and the body of the garment wearer is wetted, causing the wearer to begin to feel uncomfortable.

U.S. Pat. No. 5,312,667, owned by Malden Mills Industries, Inc., describes a composite textile fabric with a first layer made of either polyester or nylon material, and a second layer having a substantial portion of a moisture absorbent material, such as cotton. U.S. Pat. No. 5,547,733, also owned by Malden Mills Industries, Inc., describes a composite textile fabric that includes an inner fabric layer made of a yarn comprising a plurality of fibers, primarily of polyester, which have been rendered hydrophilic, and an outer fabric layer made of a yarn comprising a plurality of fibers, primarily of polyester, which have also been rendered hydrophilic. For each of these patented textile fabrics, the two fabric layers are formed concurrently by knitting a plaited construction so that the layers are distinct and separate, yet integrated one with the other.

While the textile fabrics described in both of these Malden Mills patents are advantageous, they are less than desirable. In each of these textile materials, liquid sweat migrates from the inner layer to the outer layer. During migration, the oily mixture of lipids and proteins which is secreted by the wearer migrates along with the liquid sweat. As a result of the bacterial decomposition of these lipids and proteins, which are concentrated mainly in the outer layer of the textile fabric, body odor is often produced.

Accordingly, it would be desirable to provide a textile fabric which facilitates water transport to promote evaporation and keep the wearer dry, but which also substantially eliminates the production of body odor.

SUMMARY OF THE INVENTION

Generally speaking, in accordance with the invention, a composite textile fabric for holding liquid moisture away from the skin and evaporating that moisture from the surface of its outer layer is provided. The composite fabric includes a first or inner fabric layer made of a synthetic yarn material which is naturally or has been chemically rendered to be, hydrophilic, and a second or outer fabric layer made of a yarn material selected from the group consisting of a moisture-absorbent yarn material such as cotton, a synthetic yarn material, such as polyester, acrylic or nylon, which has been rendered hydrophilic, or a combination thereof. The inner fabric layer and outer fabric layer are formed concurrently by knitting a plaited construction so that the layers are distinct and separate, yet integrated with one another.

Significantly, treated fibers with anti-microbial properties are blended exclusively in the yarn of the outer layer of the inventive textile fabric construction. Accordingly, any oily mixture of lipids and proteins that is secreted, from the wearer and then migrates with the liquid sweat from the wearer's skin through the inner layer, ultimately collects in the outer layer of the fabric, does not decompose, and the production of body odor is therefore substantially eliminated.

Importantly, treated fibers with the anti-microbial properties are not blended in the inner fabric layer. This is important since it is disadvantageous to interfere with bacterial growth next to the skin of the wearer. Bacterial growth is not harmful and is known to provide some protection to the skin.

Preferably, the treated fibers having anti-microbial properties are selected from nylon fibers coated with silver or nylon fibers coated with copper sulfide. These fibers are blended with the yarn material of the second or outer fabric layer in an amount between about 0.5 and 30 weight percent. The yarn blended with the treated fiber may be knit into every course for the highest degree of anti-microbial effect, every other course, every third course, and so on, to vary the level of anti-microbial effect that is desired.

Accordingly, it is an object of the invention to provide an improved composite textile fabric for enhancing the transport of moisture away from the skin.

It is also an object of the invention to provide an improved composite textile fabric having a plurality of synthetic yarn fibers for conducting liquid moisture.

Another object of the invention is to provide an improved composite textile fabric which includes plaited layers for promoting the moisture concentration gradient therebetween.

A further object of the invention is to provide a composite textile fabric which includes an outer moisture absorbent layer or an inner layer made from a synthetic yarn which has been rendered hydrophilic.

Yet another object of the invention is to provide a composite textile fabric which includeds an elastomeric yarn to render the fabric stretchable.

Still another object of the invention is to provide a composite textile fabric in which some of the fibers used to produce the fabric have anti-microbial properties.

Yet a further object of the invention is to provide a composite textile fabric which inhibits bacterial proliferation in the outer fabric layer.

Still a further object of the invention is to provide a composite textile fabric which substantially eliminates the production of body odor.

Still other objects and advantages of the invention will in part be obvious and will in part be apparent from the following description.

The invention accordingly comprises fabric and fabric materials having the features, properties and relation of constituents which are exemplified in the following detailed disclosure, and the scope of the invention will be indicated in the claims.

DETAILED DESCRIPTION OF THE PREFERRED EMBODIMENT

The composite textile fabric of the invention includes a first or inner fabric layer made of a synthetic yarn material and a second or outer fabric layer made of a yarn material selected from the group consisting of a moisture-absorbent yarn material, a synthetic yarn which has been rendered hydrophilic, or a combination thereof. Both fabric layers are formed concurrently by knitting a plaited construction so that the layers are distinct and separate, yet integrated one with the other.

The inner fabric layer comprises between about 30 and 70 percent by weight of the fabric. The outer fabric layer comprises between about 30 and 70 percent by weight of the fabric. The amount of each fabric layer is selected based on the desired weight of the composite fabric, the use of the composite fabric, and the specific requirements for transferring moisture from the inner fabric layer to the outer fabric layer. The weight per unit area of the composite fabric is between about 3 ounces/yard$^2$ and 15 ounces/yard$^2$, depending upon the use requirements, thermal protection and moisture control.

In accordance with the invention, the construction of the composite fabric is such that it has a plaited effect. Although each fabric layer is distinct and separate, each is integrated with the other. As a result, the composite fabric functions as a single unit.

The composite fabric is constructed as a warp or weft knit, such as a 2-end fleece, 3-end fleece, terry with regular plaiting, double terry, double needle raschel, double knit, plaited jersey and tricot.

The second or outher fabric layer, as stated above, may be made entirely of a synthetic yarn material, a moisture absorbent yarn material, or it may be a blend of the two. It may also include an elastomeric yarn material. If a moisture absorbent yarn material is included in combination with a synthetic yarn material, the moisture-absorbent yarn material is present in an amount of at least 10 percent by weight, and preferably in an amount of at least 50 percent by weight, and the synthetic yarn material will have been rendered hydrophilic. The preferred moisture-absorbent material is cotton, as it can absorb 2 to 3 times its weight in water. Other suitable moisture-absorbent materials include rayon and wool, as well as other natural fibers.

Alternatively, the second or outer fabric layer is made entirely from a synthetic yarn material, such as nylon or polyester, which has been rendered hydrophilic.

The first or inner fabric layer comprises either polyester, acrylic or nylon material which is or has been rendered hydrophilic. It may also include an elastomeric yarn material. The surface of the first fabric layer may be raised. This is achieved by either sanding, brushing or napping the surface. Thus, in the preferred embodiment, the first fabric layer comprises a raised surface fabric, with each fiber end being a conductor of moisture.

The first or inner fabric layer may utilize a fiber with a modified cross-section or it may be chemically treated so that it is rendered hydrophilic, as described in U.S. Pat. No. 5,312,667, which is hereby incorporated by reference. If the second or outer fabric layer comprises a synthetic yarn material which has been rendered hydrophilic, the denier per fiber will be smaller than the denier per fiber of the yarn in the first or inner fabric layer. This is also achieved as described in U.S. Pat. No. 5,312,667.

In the embodiment in which the second or outer fabric layer comprises a moisture-absorbent yarn material, transport of water from the surface of the first or inner fabric layer to the moisture-absorbent second or outer fabric layer is enhanced due to the first fabric layer being rendered hydrophilic. In particular, liquid moisture is made readily transportable along the surface of each polyester, acrylic or nylon fiber.

In the embodiment in which both the yarns of the first and second fabric layers are synthetic materials and are naturally, or are rendered, substantially hydrophilic, the transfer of water from the surface of the first or inner fabric layer to the second or outer fabric layer is also enhanced. Particularly, liquid moisture is made transportable along the surface of each fiber of the first or inner fabric layer. Moisture that has been conducted to the second or outer fabric layer spreads along the surface of that layer, and is rapidly evaporated, enabling the outer fabric layer to remain substantially dry.

In accordance with the inventive composite textile fabric, treated fibers with anti-microbial properties are blended exclusively in the outer fabric layer. These treated fibers may be selected from nylon or other man-made fibers treated with a silver or copper sulfide coating in order to inhibit bacterial proliferation. Nylon that is coated with silver or copper sulfide is available in the marketplace. Also, nylon which has silver or copper sulfide embedded within the fiber is also available in the marketplace. Whether the nylon or other synthetic yarn is either coated with silver or copper sulfide, or has one of these substances embedded therein, the amount of this special fiber that is blended into the yarn of the second layer is between about 0.5% and 30% by weight.

Testing of composite textile fabrics in which the second or outer fabric layer has incorporated therein nylon or another synthetic yarn coated or imbedded with silver or copper sulfide demonstrates that bacterial proliferation in the second layer is substantially inhibited. As a result, any oily mixture of lipids and proteins that has been secreted and which has migrated with liquid sweat from the wearer's skin through the inner layer, ultimately collecting in the outer layer of the fabric, does not decompose, and the production of body odor is substantially eliminated.

Thus, the inventive fabric, because there is nothing interposed between the first and second fabric layers, rapidly moves moisture away from the skin and through a garment made with the composite fabric, enhanced by the creation of a moisture concentration gradient. In addition, because the second fabric layer incorporates fibers with anti-microbial properties, bacterial growth in that layer is substantially eliminated, and therefore, body odor is materially reduced.

It will thus be seen that the objects set forth above, among those made apparent from the preceding description, are efficiently attained, and since certain changes may be made in the textile fabric described herein without departing from the spirit and scope of the invention, it is intended that all matter contained in the above description shall be interpreted as illustrative and not in a limiting sense.

It is also to be understood that the following claims are intended to cover all of the generic and specific features of the invention described herein, and all statements of the scope of the invention which, as a matter of language, might be said to fall therebetween.

We claim:

1. A composite textile fabric comprising a first fabric layer of a synthetic yarn material which is or has rendered hydrophilic and a second fabric layer of a material selected from the group consisting of a moisture-absorbent yarn, a synthetic yarn rendered hydrophilic, or a combination thereof;

wherein only the second fabric layer is blended with fibers having anti-microbial properties;

wherein the first and second fabric layers are formed concurrently by knitting a plaited construction.

2. The fabric of claim 1, wherein the second fabric layer is blended with fibers having anti-microbial properties in an amount between about 0.5 and 30 weight percent.

3. The fabric of claim 1, wherein the fibers having anti-microbial properties comprise fibers treated with either silver or copper sulfide.

4. The fabric of claim 3, wherein said silver or copper sulfide is coated on the fiber.

5. The fabric of claim 3, wherein the silver or copper sulfide is embedded in the fibers.

6. The fabric of claim 1, wherein the fibers are nylon treated with silver or copper sulfide.

7. The fabric of claim 1, wherein said first fabric layer has a raised surface.

8. The fabric of claim 1, wherein said first fabric layer has a flat surface.

9. The fabric of claim 1, wherein the fabric has a construction selected from the group consisting of 2-end fleece, 3-end fleece, terry with regular plaiting, double terry, double needle raschel, double knit, plaited jersey and tricot.

10. The fabric of claim 1, wherein said moisture-absorbent yarn is selected from the group consisting of cotton, rayon and wool.

11. The fabric of claim 1, wherein said synthetic yarn material of said first fabric layer is selected from the group consisting of polyester, acrylic and nylon.

12. The fabric of claim 1, wherein the first fabric layer comprises between about 30 and 70 percent by weight of the fabric, and the second fabric layer comprises between about 30 and 70 percent by weight of the fabric.

13. The fabric of claim 1, wherein said second fabric layer comprises at least 10% by weight of said moisture-absorbent yarn.

14. A composite textile fabric comprising a first fabric layer of a synthetic yarn selected from the group consisting of polyester, acrylic and nylon, said synthetic yarn of said first fabric layer being naturally, or having been rendered, hydrophilic, and a second fabric layer having one of the following materials:

a. a moisture-absorbent yarn material selected from the group consisting of cotton, rayon and wool, or b. a synthetic yarn which has been rendered hydrophilic and selected from the group consisting of polyester and nylon;

c. a combination of a moisture-absorbent yarn material selected from the group consisting of cotton, rayon and wool, and a synthetic yarn material which has been rendered hydrophilic and selected from the group consisting of polyester, acrylic and nylon;

wherein only said second fabric layer is exclusively blended in an amount between about 0.5 and 30 weight percent with synthetic yarn fibers treated with silver or copper sulfide;

wherein the first and second layers are formed concurrently by knitting a plaited construction.

15. The fabric of claim 14, wherein said blended synthetic yarn fibers are coated with silver or copper sulfide.

16. The fabric of claim 14, wherein said blended synthetic yarn fibers have silver or copper sulfide embedded therein.

17. The fabric of claim 14, wherein each of said layers has an elastomeric yarn blended therein.

* * * * *